United States Patent [19]

Schoen

[11] Patent Number: 4,718,951

[45] Date of Patent: Jan. 12, 1988

[54] METHOD OF PRODUCING CUBE-ON-EDGE ORIENTED SILICON STEEL FROM STRAND CAST SLAB

[75] Inventor: Jerry W. Schoen, Hamilton, Ohio

[73] Assignee: Armco Inc., Middletown, Ohio

[21] Appl. No.: 902,094

[22] Filed: Aug. 27, 1986

Related U.S. Application Data

[63] Continuation of Ser. No. 704,702, Feb. 25, 1985, abandoned.

[51] Int. Cl.[4] ..... H01F 1/04

[52] U.S. Cl. ..... 148/111; 148/112

[58] Field of Search ..... 148/111, 112

[56] References Cited

U.S. PATENT DOCUMENTS 2,599,340 6/1952 Littmann et al. ..... 148/111

3,764,406 10/1973 Littmann et al. ..... 148/111

3,841,924 10/1974 Sakakura et al. ..... 148/111

4,108,694 8/1978 Shiozaki et al. ..... 148/111

*Primary Examiner*—John P. Sheehan

*Attorney, Agent, or Firm*—Frost & Jacobs

[57] ABSTRACT

A method of producing cube-on-edge oriented silicon steel strip and sheet from strand cast slabs, wherein a slab is prerolled at a temperature not exceeding 1673° K. with a reduction in thickness up to 50%, and the prerolled slab is reheated to a temperature between 1533° and 1673° K. prior to hot rolling. The slab prerolling temperature, percentage of reduction in prerolling, and the reheat temperature are correlated in accordance with a specific equation in order to control the strain rate during prerolling and to obtain an average grain diameter not exceeding about 9 mm after reheating.

12 Claims, 17 Drawing Figures

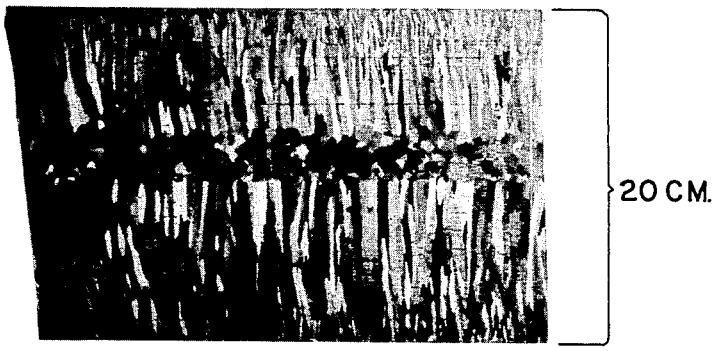
FIG. 1 0.25X

REHEAT TEMP. 1503°K.

REHEAT TEMP. 1533°K.

REHEAT TEMP. 1561°K.

REHEAT TEMP. 1616°K.

REHEAT TEMP. 1673°K.

REHEAT TEMP. 1503°K.

REHEAT TEMP. 1533°K.

REHEAT TEMP. 1616°K.

REHEAT TEMP. 1561°K.

REHEAT TEMP. 1673°K.

PREROLL TEMP. 1423° K.
REHEAT TEMP. 1673° K.

PREROLL TEMP. 1563°K.
REHEAT TEMP. 1673°K.

PREROLL TEMP. 1643°K.
REHEAT TEMP. 1673°K.

METHOD OF PRODUCING CUBE-ON-EDGE ORIENTED SILICON STEEL FROM STRAND CAST SLAB

This is a continuation of application Ser. No. 704,702, filed Feb. 25, 1985, now abandoned.

BACKGROUND OF THE INVENTION

The present invention relates to a method of producing cube-on-edge oriented silicon steel strip and sheet for magnetic uses. Cube-on-edge orientation is designated (110) [001] in accordance with the Miller Indices. The method of the present invention has utility for the production of both so-called regular grade and high permeability grade material containing from about 2% to 4% silicon of uniform magnetic properties, from a strand or continuously cast slab of a thickness suitable for direct hot rolling.

As described in U.S. Pat. No. 3,764,406, issued Oct. 9, 1973 to M. F. Littman, cube-on-edge oriented silicon steel strip or sheet is generally made by melting a silicon steel of suitable composition, refining, casting, hot reducing ingots or slabs to hot rolled bands of about 2.5 mm thickness or less, optionally annealing, removing scale, cold reducing in at least one stage to a final thickness of about 0.25 to about 0.35 mm, decarburizing by a continuous anneal in a wet hydrogen atmosphere, coating with an annealing separator and box annealing for several hours in dry hydrogen at a temperature above about 1100° C.

Two conditions must be satisfied before the high temperature portion of the final box anneal during which secondary recrystallization occurs, in order to obtain material having a high degree of cube-on-edge orientation:

(1) A suitable structure of completely recrystallized grains with a sufficient number of these grains having the final cube-on-edge orientation;

(2) The presence of inhibitors in the form of small, uniformly distributed inclusions which restrain primary grain growth in the early portions of the anneal until a vigorous secondary growth occurs during the latter, high temperature portion of the anneal.

During the secondary grain growth portion of the final anneal, the cube-on-edge grains consume other grains in the matrix having a different orientation.

U.S. Pat. No. 2,599,340, issued June 3, 1952 to M. F. Littmann et al, discloses a process for the production of cube-on-edge oriented silicon steel wherein slabs rolled from ingots are heated to a temperature above about 1260° C., and particularly from about 1350° to about 1400° C. prior to hot rolling. This heating step not only prepares the metal for hot rolling but also dissolves the inhibitor present therein so that upon subsequent hot rolling the inhibitor is precipitated in the desired form of small, uniformly distributed inclusions, thereby satisfying one of the two essential conditions for obtaining highly oriented cube-on-edge material. The primary grain growth inhibitor is usually manganese sulfide, but other inhibitors such as manganese selenide, aluminum nitride, or mixtures thereof may be used.

Strand casting into a continuous slab or casting into individual slabs of a thickness suitable for direct hot rolling is advantageous in comparison to ingot casting, in avoiding the loss of material from the butt and top portions of conventional ingots, which ordinarily must be cropped, and in decreasing the extent of hot reduction required to reach hot band thickness. However, when strand cast slabs of silicon steel are produced, a columnar grain structure is obtained which extends from each surface inwardly almost to the center of the slab, with a relatively narrow core or band of equiaxed grains at the center. When such a slab is heated above about 1300° C. prior to hot rolling by the process disclosed in the above U.S. Pat. No. 2,599,340, excessive grain growth occurs. The average diameter of grains after reheating above 1300° C. is about 25 mm (about 0.5–1.0 ASTM grain size at 1x). In comparison, the average grain diameter in slabs rolled from ingots after reheating above about 1300° C., is about 10 mm.

The above-mentioned U.S. Pat. No. 3,764,406 discloses and claims a solution to the problem of excessive grain growth, by heating a cast slab to a temperature of at least about 750° C. but below about 1250° C., initially hot reducing or prerolling the slab with a reduction in thickness of 5% to 50%, followed by the conventional step of reheating the slab to a temperature between about 1260° and 1400° C. before proceeding with conventional hot rolling. This heat treatment and prerolling made possible an average grain diameter of about 7 mm or less after reheating above 1300° C. prior to hot rolling. This in turn had a beneficial effect on the development of cube-on-edge texture in the final product and provided greatly improved uniformity in magnetic properties. Preferably the initial heating of the slab in this patent is at a temperature of about 850° to about 1150° C., and the reduction in thickness is preferably between about 10% and 50%, and more preferably about 25%. Column 7, lines 10–14 indicate that as the percent reduction increases over 25%, the benefit in terms of grain size of the reheated slab gradually diminishes.

U.S. Pat. No. 3,841,924, issued Oct. 15, 1974 to A. Sakakura et al, discloses a process very similar to that of U.S. Pat. No. 3,764,406, with the slab being heated initially to a temperature below 1300° C. and subjected to "break-down rolling" (i.e. prerolling) at a reduction rate between 30 and 70% before the conventional hot rolling step. In the specific example, a slab was initially heated at 1230° C., then subjected to prerolling.

In U.S. Pat. No. 3,841,924, the starting material contains not more than 0.085% carbon, 2.0%–4.0% silicon, 0.010%–0.065% acid-soluble aluminum, and balance iron and unavoidable impurities. The relatively high carbon content in the process of this patent helps to overcome the incomplete recrystallization associated with large grains in cast slabs. At column 3, lines 6–9, it is stated that if the slab heating temperature exceeds 1300° C., the columnar structure grows coarse and no substantial effect can be obtained by the subsequent breaking down treatment. This patent tolerates relatively large average grain diameter after reheating, the requirement being merely that more than 80% of the grains after reheating be less than 25 mm in average grain diameter.

U.S. Pat. No. 4,108,694 discloses electromagnetic stirring of continuously cast silicon steel slabs, which is alleged to prevent excessive grain growth in the central equi-axed zone of the slab after reheating to 1300°–1400° C. before hot rolling. This in turn is stated to result in improved magnetic properties in the final product. Electromagnetic stirring is equivalent in its effect to ultrasonic vibration, inoculation, or casting at a temperature very close to the solidus temperature of the metal.

While U.S. Pat. No. 3,764,406 successfully solved the problem of excessive grain growth after reheating above about 1300° C. prior to hot rolling, the process requires extra equipment for the initial heating within the range of 750° to below about 1250° C. Without such extra equipment, the practice of U.S. Pat. No. 3,764,406 will result in reduced output and increased costs for slab reheating and hot rolling by restricting the furnace capacity available for slab reheating above about 1300° prior to hot rolling.

There is thus still a need for improvement in a process for producing oriented silicon steel strip and sheet from strand cast slabs with conventional equipment which will reduce the load on the roughing mill and permit faster dropout rates in slab reheating prior to hot rolling.

SUMMARY OF THE INVENTION

The present invention constitutes a discovery that it is possible to preroll at a temperature substantially higher than the 1250° C. (1523° K.) maximum of U.S. Pat. No. 3,764,406 and still obtain the desired recrystallized grain size prior to the start of hot rolling. The higher prerolling temperatures possible in the process of the present invention ease the load on the roughing mill and enable faster dropout rates in slab reheating prior to hot rolling because the prerolled slabs are hotter when subjected to the final stage of slab reheating prior to hot rolling. The present process thus minimizes and could even eliminate the reheating step and avoid the need for two furnaces heated to two different temperatures. More specifically, as a result of energy storage, recrystallization and grain growth studies, the applicant has found that prerolling is effective over a much wider range of conditions than previously thought to be possible, and that the optimum prerolling conditions are related to the slab reheating temperature. As used herein, the term prerolling designates initial hot reduction which may be conducted in a conventional roughing mill in commercial practice. In the laboratory a hot rolling mill may be used.

According to the invention, there is provided a method of producing cube-on-edge oriented silicon steel strip and sheet from strand cast slabs, comprising the steps of providing a strand cast slab containing from 2% to 4% silicon and having a thickness of about 10 to about 30 cm, prerolling the slab while at a temperature not exceeding 1673° K. (1400° C.) with a reduction in thickness up to 50%, reheating said prerolled slab to a temperature between about 1533° and 1673° K. (1260° and 1400° C.), correlating the slab prerolling temperature, percentage of reduction in prerolling, and the reheat temperature, whereby to control the strain rate during prerolling and to obtain an average recrystallized grain diameter not exceeding about 9 mm after reheating, in accordance with the equation:

$$(K^*)^{-1} = (T_{SR}) \times \ln\left[\dot{\epsilon}^{0.15} \exp\left(\frac{7616}{T_{PR}}\right) \ln\left(\frac{t_i}{t_f}\right)\right] \geqq 6400$$

where $(K^*)^{-1}$=strain/recrystallization parameter $T_{SR}$=slab reheating temperature °K.

$\epsilon$=strain rate in prerolling $T_{PR}$=slab prerolling temperature °K.

$t_i$=as-cast slab thickness $t_f$=prerolled slab thickness, hot reducing to hot band thickness after reheating, cold reducing to final thickness in at least one stage, decarburizing, and finally annealing under conditions which effect secondary recrystallization.

BRIEF DESCRIPTION OF THE DRAWING

FIG. 1 is a photograph at 0.25× magnification of a transverse section of a 20 cm thickness strand cast slab of silicon steel in the as-cast condition;

FIGS. *2a* through *2e* are photographs at 0.5× magnification of etched transverse sections of 70 mm cubes taken from the surface of a heat (Code A in Table I) of a 20 cm thickness strand cast slab, each photograph showing different slab reheat temperatures ranging from 1503° to 1673° K. (1230° to 1400° C.), without prerolling (i.e., not in accordance with the invention);

FIGS. *2f* through *2j* are photographs of another heat (Code I in Table I) subjected to the same conditions as FIGS. *2a* through *2e;*

FIGS. *3a* through *3c* are photographs at 1× magnification of etched transverse sections of 70 mm cubes taken from the surface of a heat (Code A in Table I) of a 20 cm thickness strand cast slab prerolled with 50% reduction at 1423°, 1563° and 1643° K. (1150°, 1290° and 1370° C.), respectively, and reheated to 1673° K. (1400° C.), in accordance with the invention.

Figure 4:
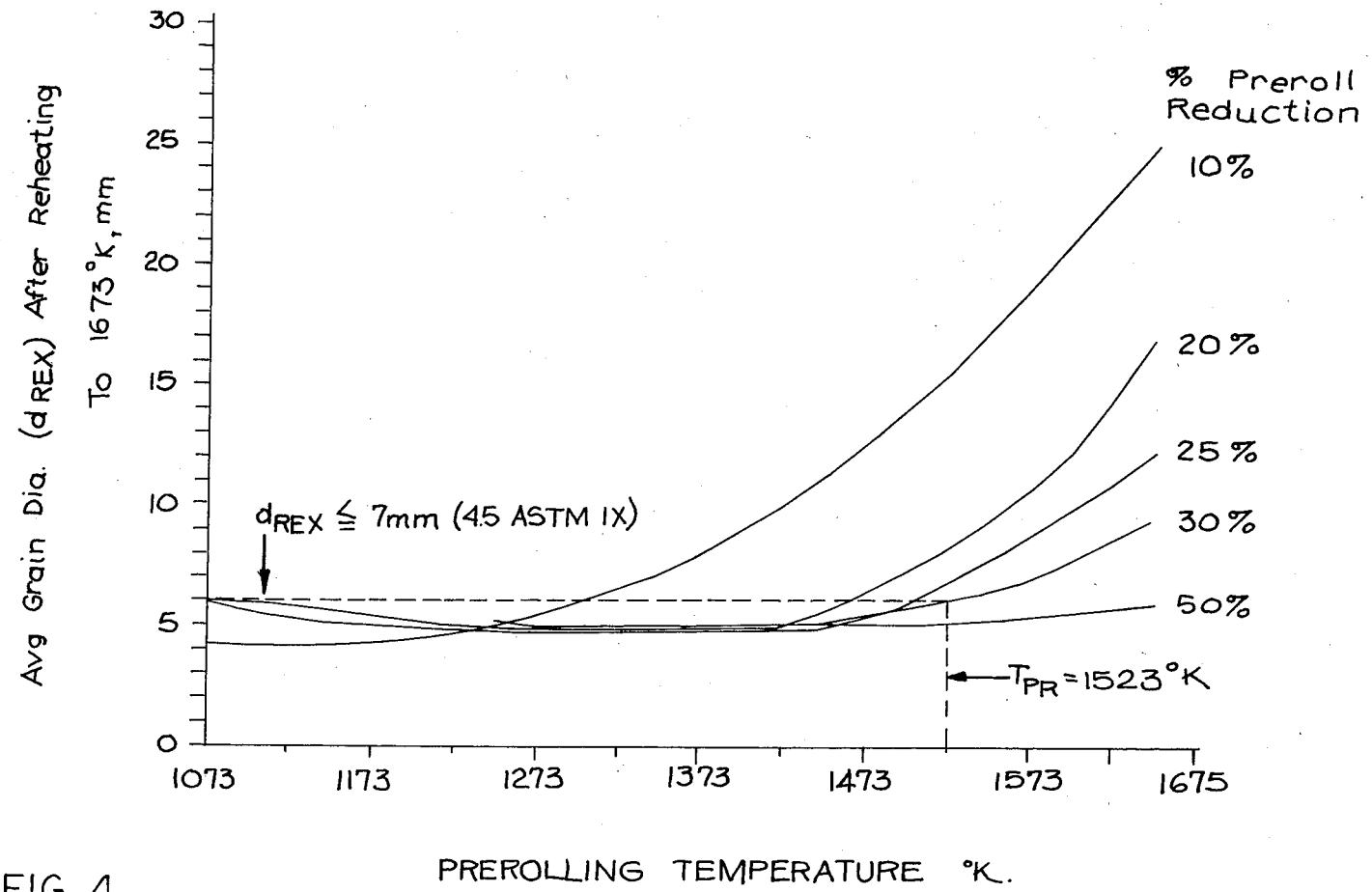
Figure 5:
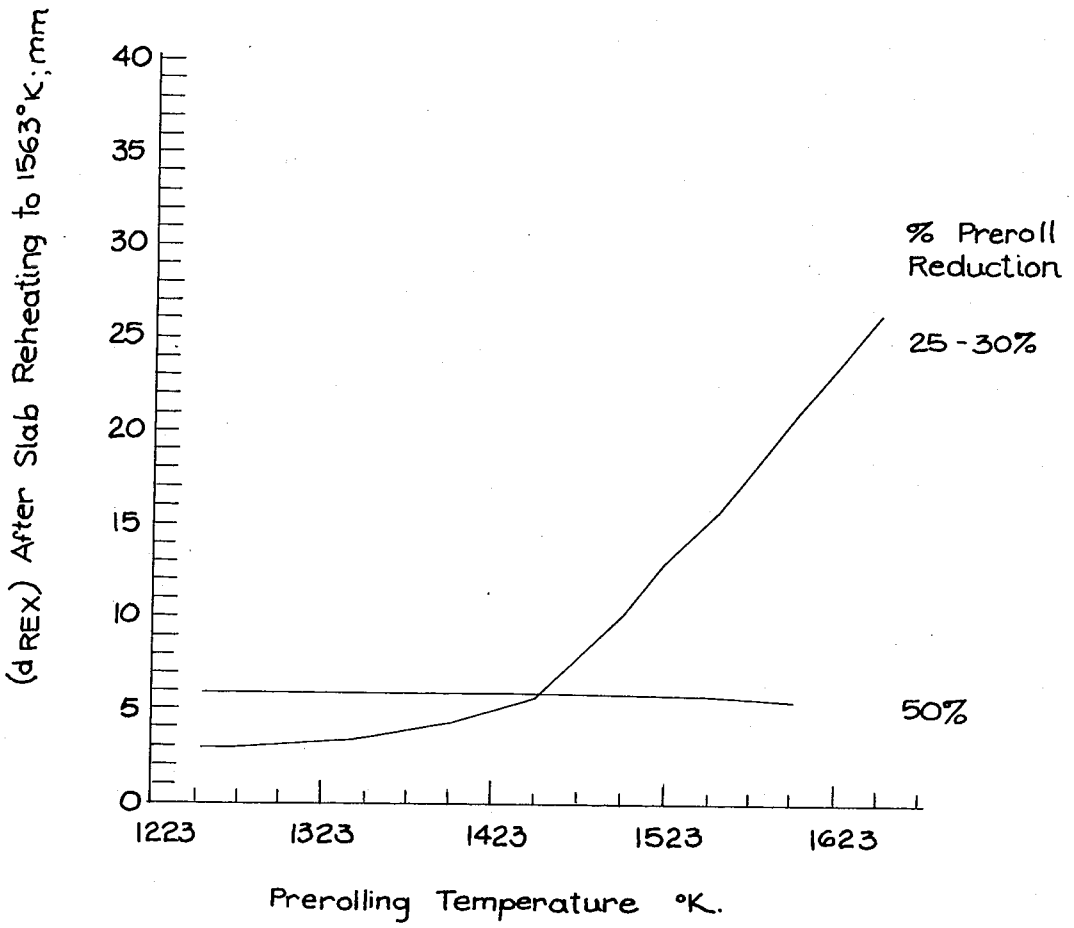
Figure 6:
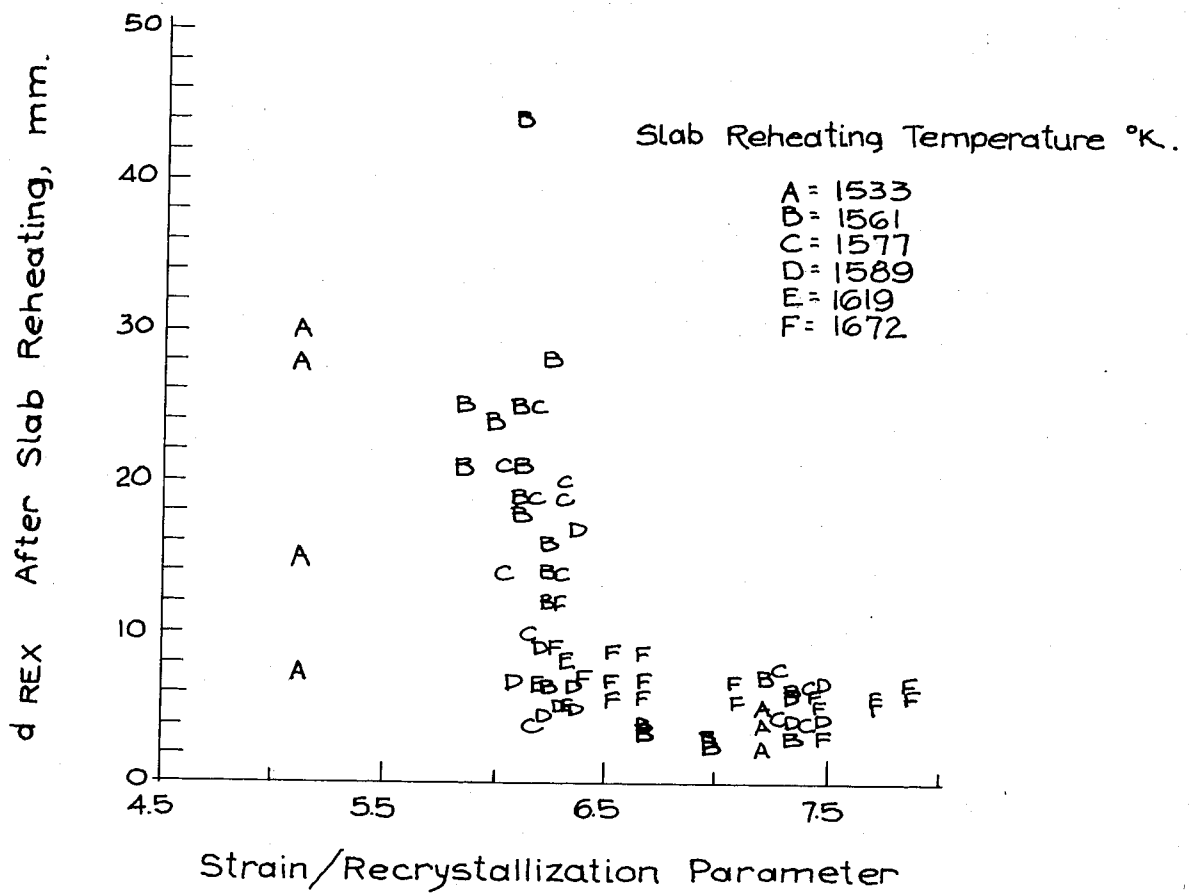

FIG. 4 is a graphic comparison of average grain diameter after reheating to 1673° K. (1400° C.) vs the preheat temperature for prerolling;

FIG. 5 is a graphic comparison of average grain diameter after reheating to 1563° K. (1290° C.) vs preroll temperature and percent reduction; and FIG. 6 is a graphic representation of the effect of the strain/recrystallization parameter vs recrystallized grain size after reheating to various temperature levels.

DETAILED DESCRIPTION

Applicant has conducted studies establishing that excessive grain growth during the reheating of continuous cast slabs before hot rolling results from the extensive subgrain structure developed due to the strains induced during and after continuous casting. Prerolling prior to slab reheating refines the grain size in the reheated slab (prior to hot rolling) by imparting sufficient additional plastic deformation, or strain energy, to enable the higher energy processes of recrystallization and grain growth to occur.

The model on which the process of the invention is based combines the effects of the percent reduction effected in prerolling and the high temperature yield strength (i.e. the prerolling temperature) to calculate the true strain stored in prerolling. The effect of the reheating temperature used prior to hot rolling on the release of this stored energy and the resulting recrystallized grain size is also incorporated in the model.

Based on published work by others, the energy expended in strip rolling can be calculated as shown below (with assumptions that the frictional losses of rolling are zero, that the temperature through the slab thickness is uniform and that the deformation strands are distributed uniformly through the slab thickness):

$$W = \sigma_c \ln\left[\frac{1}{1-R}\right] \quad (1)$$

where

W=work expended in reduction $\sigma_c$=constrained yield strength

R=reduction (in decimal fraction or %/100)

The true strain can be calculated as:

$$\epsilon = KW \tag{2}$$

where $\epsilon$=true strain

K=constant

Combining equations 1 and 2 above, the relation may be expressed as:

$$\epsilon = K\sigma_c \ln\left(\frac{t_i}{t_f}\right) \tag{3}$$

where $t_i$=as-cast slab thickness $t_f$=prerolled slab thickness

The constrained yield strength ($\sigma_c$) is related to the yield strength of the material prior to its deformation. In hot rolling, recovery occurs dynamically and strain hardening does not occur. However, the yield strength at elevated temperatures depends markedly on the temperature and strain rate.

Applicant has determined the solution to the Zener-Holloman relationship which describes the effect of temperature and strain rate on the 0.2% yield strength for 3.1% silicon steel for non-textured, primary recrystallization materials at temperatures above about 537° C., as follows:

$$\sigma_T = 4.019\,\dot{\epsilon}^{0.15} \exp\left[\frac{7616}{T_{PR}}\right] \tag{4}$$

where $\dot{\epsilon}$=strain rate $T_{PR}$=prerolling temperature (°K.)

$\sigma_T$=temperature and strain rate compensated yield strength

For purposes of the present invention $\sigma_T$ is substituted for $\sigma_c$ in equation 3 to obtain:

$$\epsilon = K'\,\dot{\epsilon}^{0.15} \exp\left[\frac{7616}{T_{PR}}\right] \ln\left(\frac{t_i}{t_f}\right) \tag{5}$$

where K'=4.019 K.

An earlier publication has summarized the relation of the mean strain rate ($\dot{\epsilon}$) in hot rolling to the work roll radius (r in inches), roll rotational rate (n in revolutions per second) and the initial and final thicknesses ($t_i$ and $t_f$, respectively):

$$\dot{\epsilon} = \frac{2\pi rn}{\sqrt{rt_i}} \sqrt{\frac{t_i - t_f}{t_i}} \left[1 + \tfrac{1}{4}\left(\frac{t_i - t_f}{t_i}\right)\right] \tag{6}$$

Equation 6 can be rearranged, simplified and combined with equation 5 by substituting $\dot{\epsilon}$ for $\epsilon$ in equation 5 to obtain:

$$\frac{\epsilon}{K'} = \tag{7}$$

-continued $$\left\{\frac{2\pi n}{t_i}\sqrt{r(t_i - t_f)}\left[1.25 - \frac{t_f}{4t_i}\right]\right\}^{0.15} \exp\left(\frac{7616}{T_{PR}}\right) \times \ln\left(\frac{t_i}{t_f}\right).$$

The final component of the model is the relationship between the rolling strain ($\epsilon$), the grain size ($d_{REX}$) after slab reheating for hot rolling and the slab reheating temperature ($T_{SR}$).

$$d_{REX} = \epsilon^{-1} d_o^{0.67} D \tag{8}$$

where $\epsilon$=strain $d_o$=initial grain size

D=rate of recrystallization nuclei formation and grain growth $$D = D_o \exp\left[\frac{-Q_{REX}}{RT_{SR}}\right] \tag{9}$$

where

R=Boltzmann's constant $Q_{REX}$=activation energy for nuclei formation and grain growth $T_{SR}$=slab reheating temperature (°K.)

For purposes of the present invention, it has been found that changes in $d_o$ do not appear to have a significant effect, so that $d_o$ can be eliminated from equation 8, as explained hereinafter. Equation 8 thus reduces to:

$$d_{REX} = C\epsilon^{-1} D \tag{8a}$$

where

C=constant

Equation 8a can be rearranged to obtain:

$$\frac{1}{T_{SR}} = \left(\frac{R}{-Q}\right) \ln \frac{d_{REX}\,\epsilon}{C} \tag{10}$$

Assuming that the recrystallized grain size ($d_{REX}$) desirably is a constant (9 mm or less), this can be reduced to:

$$\frac{1}{T_{SR}} = C' \ln \epsilon \tag{10a}$$

where $$C' = -\frac{R}{Q} \ln \frac{d_{REX}}{C} = \text{constant}$$

or $$\frac{1}{C'} = T_{SR} \ln \epsilon. \tag{10b}$$

Equation 5 can be substituted into equation 10b to obtain a single unified expression:

$$(K^*)^{-1} = (T_{SR}) \ln\left[\dot{\epsilon}^{0.15} \exp\left(\frac{7616}{T_{PR}}\right) \ln\left(\frac{t_i}{t_f}\right)\right] \tag{11}$$

where $(K^*)^{-1}$ = strain/recrystallization parameter and $(K^*)^{-1} = T_{SR} \ln \epsilon$. (11a)

A series of separate prerolling and slab reheating experiments was conducted, in which slab samples were taken from the surface columnar grain region of as-cast slab samples. FIG. 1 shows the columnar grain region at each surface. The samples were cut into nominal 70 mm cubes and heated to temperature for prerolling in one hour in a nitrogen atmosphere, prerolled in one pass, and then immediately recharged and reheated to the desired slab reheating temperature in one hour under a nitrogen atmosphere. Prerolling was carried out on a one-stand, two-inch laboratory hot rolling mill using 24.1 cm (9.5 inch) diameter rolls operating at 32 RPM. After air cooling, the samples were cut in half transverse to the rolling direction and etched in hydrochloric acid and hydrofluoric acid to reveal the grain structure.

The compositions of the heats used in these tests are set forth in Table I.

Experiment No. 1 was a study of prerolling temperature and reduction with 1673° K. (1400° C.) slab reheating.

Experiment No. 2 was a study of prerolling temperature and reductions with 1563° K. (1290° C.) slab reheating.

Experiment No. 3 was a study of prerolling temperature and slab reheating temperature interaction.

The conditions for each of the above three experiments are summarized as follows:

EXPERIMENT NO. 1

Slab reheating temperature 1673° K. (1400° C.)

| Material | Prerolling Temp. °C. | Prerolling Temp. °K. | % Prerolling Reduction |
|---|---|---|---|
| Codes A, B, C D, H, X | 1150 | 1423 | 10, 20, 25, 30, 50 |
| | 1232 | 1505 | 25 |
| | 1288 | 1561 | 10, 20, 25, 30, 50 |
| | 1316 | 1589 | 25 |
| | 1371 | 1644 | 10, 20, 25, 30, 50 |

EXPERIMENT NO. 2

Slab reheating temperature 1563° K. (1290° C.)

| Material | Prerolling Temp. °C. | Prerolling Temp. °K. | % Prerolling Reduction |
|---|---|---|---|
| Codes I, M | 982 | 1255 | 25 |
| | 1149 | 1422 | 25 |
| | 1204 | 1477 | 25 |
| | 1288 | 1561 | 10, 25, 30 |
| | 1316 | 1589 | 10, 25, 30 |
| | 1371 | 1644 | 25 |

EXPERIMENT NO. 3

| Material | Prerolling Temp. °C. | Prerolling Temp. °K. | % Prerolling Reduction | Slab Reheating Temp. °C. | Slab Reheating Temp. °K. |
|---|---|---|---|---|---|
| Codes I, M. | 982 | 1255 | 30, 50 | 1290 | 1563 |
| | 1150 | 1423 | 30, 50 | 1290 | 1563 |
| | | | | 1400 | 1673 |
| | 1204 | 1477 | 30 | 1290 | 1563 |
| | 1212 | 1485 | 30 | 1400 | 1673 |
| | 1290 | 1563 | 30, 50 | 1260 | 1533 |
| | | | | 1290 | 1563 |
| | | | | 1304 | 1577 |
| | | | | 1316 | 1589 |

EXPERIMENT NO. 3-continued

| Material | Prerolling Temp. °C. | Prerolling Temp. °K. | % Prerolling Reduction | Slab Reheating Temp. °C. | Slab Reheating Temp. °K. |
|---|---|---|---|---|---|
| | | | | 1400 | 1673 |
| | 1316 | 1589 | 30, 50 | 1290 | 1563 |
| | | | | 1304 | 1577 |
| | | | | 1316 | 1589 |
| | | | | 1346 | 1619 |
| | | | | 1400 | 1673 |
| | 1346 | 1619 | 30 | 1290 | 1563 |
| | | | | 1304 | 1577 |
| | | | | 1316 | 1589 |
| | | | | 1345 | 1618 |
| | | | | 1400 | 1673 |
| | 1400 | 1673 | 30, 50 | 1290 | 1563 |
| | | | | 1400 | 1673 |

Figure 2A:
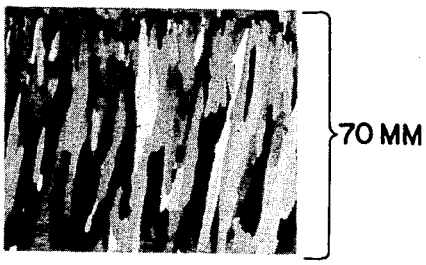
Figure 2B:
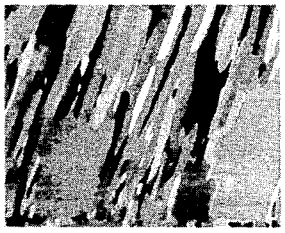
Figure 2C:
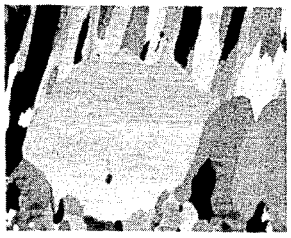
Figure 2D:
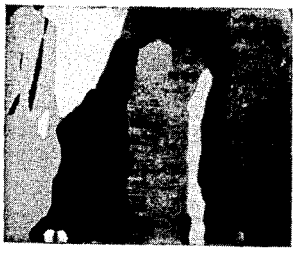
Figure 2E:
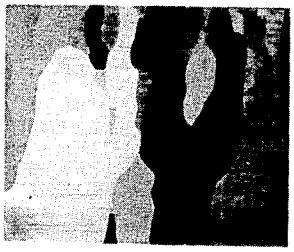
Figure 2F:
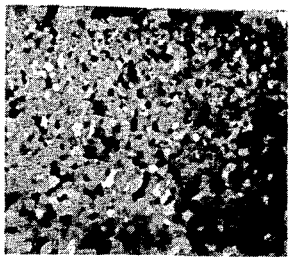
Figure 2G:
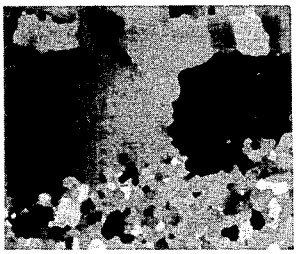
Figure 2I:
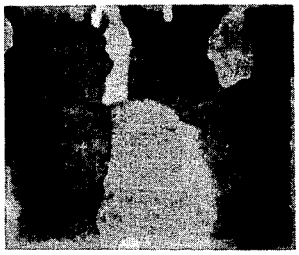
Figure 2H:
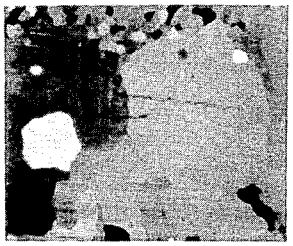
Figure 2J:
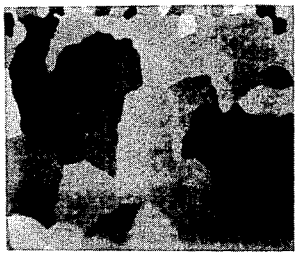
Figure 3A:
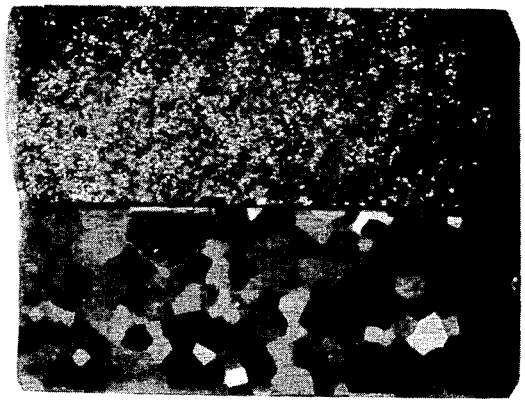
Figure 3B:
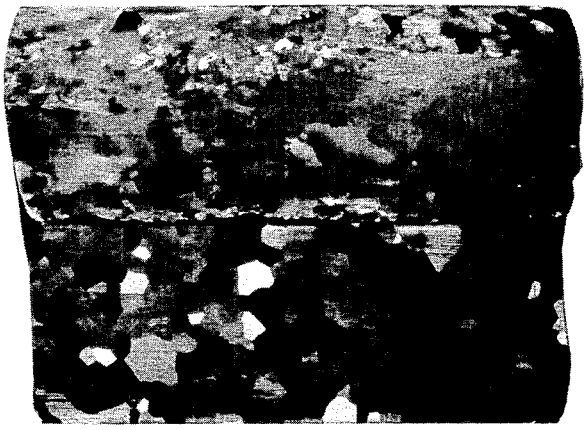
Figure 3C:
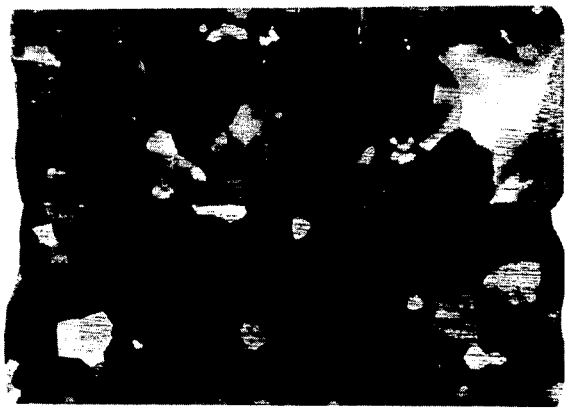

FIGS. 2*a* through 2*j* show slab reheat temperatures of 1503°, 1533°, 1563°, 1618° and 1673° K. (1230°, 1260°, 1290°, 1345° and 1400° C.), without prerolling. Despite the fact that these heats were cast very near the solidification temperature, it is apparent that the grain sizes were large. FIGS. 3*a* through 3*c* show (in the upper half of each photograph) the grains immediately before prerolling (50% reduction) at three different prerolling temperatures, 1423° K. (1150° C.) in FIG. 3*a;* 1563° K. (1290° C.) in FIG. 3*b;* and 1643° K. (1370° C.) in FIG. 3*c*. The differences in grain sizes are readily apparent. The lower half of each of FIGS. 3*a* through 3*c* shows the prerolled grains after reheating to 1673° K. (1400° C.) in preparation for hot rolling. These grain sizes are all substantially the same and average less than 9 mm in diameter. This supports the above statement that initial grain size before prerolling ($d_o$ in Equation 8) does not have a significant effect.

The results of Experiment No. 1 are reported in Table II and FIG. 4, and show the effect of the prerolling temperature and percent reduction on the grain size after reheating to 1673° K. (1400° C.). In FIG. 4 the boundary conditions of the above-mentioned U.S. Pat. No. 3,746,406 are also shown in broken lines. It is evident that with reduction of 25% to 50%, prerolling temperatures above the upper limit of this U.S. Pat. No. are permissible with slab reheating of 1673° K. (1400° C.). The computer-generated curves of FIG. 4 also show that contours are obtained with varying reduction percentages and prerolling temperatures. More specifically, at a prerolling temperature ranging from greater than 1523° to about 1643° K. (1250° to about 1370° C.), prerolling reductions of 30% to 50% would produce recrystallized average grain diameters not greater than 9 mm, after slab reheating to 1673° K. (1400° C.).

Table III and FIG. 5 summarizes the results of Experiment No. 2. This shows the effect of percentage reduction and prerolling temperature on grain size after slab reheating to 1563° K. (1290° C.). Prerolling temperatures of 1253° to 1473° K. and reductions of 25% to 50% resulted in average recrystallized grain diameters of 7 mm or less. FIG. 5 shows computer-generated curves also having contours similar to those of FIG. 4, but at prerolling temperatures of 1523° to 1643° K. (1250° C. to 1370° C.) prerolling reductions of 25% to 30% did not result in a refined grain size. However, a prerolling reduction of 50% did produce this desired effect throughout the prerolling temperature range.

The data from Experiments 1 and 2 indicate that the calculated strain level necessary to promote the same amount of recrystallization and grain growth at 1563° (1290° C.) is substantially higher than that necessary at 1673° K. (1400° C.). In simple terms, it takes more strain to produce the same amount of recrystallization and grain growth (i.e to obtain the same grain size) at a lower slab reheating temperature.

On the basis of the above findings, Experiment No. 3 was designed to investigate the parameters more precisely. Table IV and FIG. 6 summarize the results of Experiment No. 3. It is clear from these data that when $(K^*)^{-1}$ is less than 6400, incomplete and/or erratic recrystallization occurs. On the other hand, when $(K^*)^{-1}$ is greater than 6400, complete recrystallization is achieved consistently. The desired condition is complete recrystallization in the slab prior to hot rolling, and the present invention has established empirically that if the strain/recrystallization parameter, i.e. $(K^*)^{-1}$, is 6400, the prerolling and slab reheating conditions are conducive to providing a desired grain size not exceeding about 9 mm, and preferably not exceeding about 7 mm, after reheating.

From the equations set forth above, it is possible in accordance with the invention to calculate optimum conditions as a function of a particular control variable. For example, the maximum prerolling temperature can be ascertained from predetermined percentage of preroll reduction and predetermined slab reheat temperature, these predetermined parameters in some cases being dictated by available equipment. For example, if equipment for a 25% to 30% single pass reduction is available, and if a slab reheating temperature of 1673° K. (1400° C.) is the maximum practicable temperature, the maximum permissible preheat temperature for prerolling is 1615°0 K. (1343° C.). Table V contains a series of calculations showing maximum permissible prerolling temperatures for various slab reheating temperatures at 25% and 30% prerolling reductions in a single pass, using a one-stand, two-high laboratory hot rolling mill having 24.1 cm diameter rolls operating at 32 RPM. It will of course be recognized that if larger percentage reductions in one or two passes are effected, still higher preheat temperatures for prerolling would be permissible, as well as increased strain rates in prerolling by higher work roll rotational speed and larger roll diameters.

The use of higher prerolling temperatures decreases the load on the roughing mill and enables faster dropout rates in the slab reheating step prior to hot rolling since the incoming slab temperature would be higher. These advantages not only decrease processing costs but result in more uniform and consistent magnetic properties in the final product.

The composition of the silicon steel which may be subjected to the process of the present invention is not critical and may conform to the conventional compositions used both for regular grade and high permeability grade electrical steels. For regular grade cube-on-edge oriented material, a preferred as cast composition would range, in weight percent, from 0.001%–0.085% carbon, 0.04%–0.15% manganese, 0.01%–0.03% sulfur and/or selenium, 2.95%–3.35% silicon, 0.001%–0.065% aluminum, 0.001%–0.010% nitrogen, and balance essentially iron. For high permeability grade cube-on-edge oriented material, an exemplary as-cast composition contains, in weight percent, up to about 0.07% carbon, about 2.7% to 3.3% silicon, about 0.05% to about 0.15% manganese, about 0.02% to about 0.035% sulfur and/or selenium, about 0.001% to about 0.065% total aluminum, about 0.0005% to about 0.009% nitrogen, and balance essentially iron. Boron, copper, tin, antimony and the like may be added to improve the control of grain growth. The compositions shown in Table I are generally representative, with minor departures from preferred ranges in several instances, which did not seriously detract from the desired properties.

The duration of the slab preheating prior to prerolling and of the slab reheating prior to hot rolling is not critical and preferably is on the order of one hour. The experimental data reported herein are based generally on one hour heating time, and increases up to four hours heating were found to have little influence. Preferably an inert atmosphere is used during heating.

From the above description it will be apparent to those skilled in the art that the present invention has particular advantage for installation equipped with in-line rolling after continuous casting.

TABLE I

| | Compositions - Weight % - Ladle Analysis | | | | | |
|---|---|---|---|---|---|---|
| Code | C | Mn | S | Si | Al | N |
| A | .027 | .060 | .022 | 3.14 | .0013 | .0049 |
| B | .038 | .064 | .022 | 3.15 | .0011 | .0045 |
| C | .027 | .077 | .022 | 3.18 | .0019 | .0057 |
| D | .027 | .060 | .023 | 3.16 | .0010 | .0072 |
| H | .028 | .058 | .026 | 3.19 | .011 | .0045 |
| X | .043 | .035 | .025 | 2.93 | .030 | .0071 |
| I | .027 | .068 | .021 | 3.12 | .0024 | .0028 |
| M | .028 | .059 | .022 | 3.13 | .0071 | .0029 |

TABLE II

| | | Slab grain size ($d_{REX}$) after reheating to 1673° K. (1400° C.) (grain sizes calculated based on equivalent circular diameter model - in mm) | | | | | | | | | | | | | | |
|---|---|---|---|---|---|---|---|---|---|---|---|---|---|---|---|---|
| | Preroll | % Reduction in Prerolling (Single Pass) | | | | | | | | | | | | | | |
| | Temp. | 10% Reduction | | | 20% Reduction | | | 25% Reduction | | | 30% Reduction | | | 50% Reduction | | |
| Material | °K. | E | $(K.^*)^{-1}$ | $d_{REX}$ | E | $(K.^*)^{-1}$ | $d_{REX}$ | E | $(K.^*)^{-1}$ | $d_{REX}$ | E | $(K.^*)^{-1}$ | $d_{REX}$ | E | $(K.^*)^{-1}$ | $d_{REX}$ |
| Code | | | | | | | | | | | | | | | | |
| A | 1422 | 24 | 5282 | 11 | 53 | 6630 | 7.5 | 69 | 7085 | 5.5 | 87 | 7471 | 3.9 | 177 | 8657 | 4.0, 5.2 |
| B | " | | | 15 | | | 4.8 | | | 4.8 | | | 3.7 | | | 5.7, 5.7 |
| C | " | | | 12 | | | 4.8 | | | 4.2 | | | 3.9 | | | |
| D | " | | | 10 | | | 5.5 | | | 5.3 | | | 4.4 | | | |
| H | " | | | 6.7 | | | 5.1 | | | 4.1 | | | 3.7 | | | |
| X | " | | | 17 | | | 4.8 | | | 3.9 | | | 3.3 | | | |
| (average) | | | | (11.9) | | | (4.6) | | | (4.6) | | | (3.8) | | | (5.2) |
| A | 1505 | | | | | | | 52 | 6591 | 7.2 | | | | | | |
| B | " | | | | | | | | | 5.2 | | | | | | |
| C | " | | | | | | | | | 4.8 | | | | | | |
| D | " | | | | | | | | | 7.0 | | | | | | |
| H | " | | | | | | | | | 4.0 | | | | | | |
| X | " | | | | | | | | | 4.0 | | | | | | |

TABLE II-continued

Slab grain size ($d_{REX}$) after reheating to 1673° K. (1400° C.)
(grain sizes calculated based on equivalent circular diameter model - in mm)

| Material | Preroll Temp. °K. | % Reduction in Prerolling (Single Pass) | | | | | | | | | | | | | | |
|---|---|---|---|---|---|---|---|---|---|---|---|---|---|---|---|---|
| | | 10% Reduction | | | 20% Reduction | | | 25% Reduction | | | 30% Reduction | | | 50% Reduction | | |
| | | E | $(K.^*)^{-1}$ | $d_{REX}$ | E | $(K.^*)^{-1}$ | $d_{REX}$ | E | $(K.^*)^{-1}$ | $d_{REX}$ | E | $(K.^*)^{-1}$ | $d_{REX}$ | E | $(K.^*)^{-1}$ | $d_{REX}$ |
| (average) | | | | | | | | | | (5.4) | | | | | | |
| Code | | | | | | | | | | | | | | | | |
| A | 1561 | 15 | 4485 | 28 | 33 | 5832 | 16 | 43 | 6288 | 14 | 54 | 6673 | 10 | 110 | 7860 | 4.9, 5.5 |
| B | " | | | 15 | | | 6.5 | | | 6.8 | | | 5.3 | | | 5.5, 6.3 |
| C | " | | | 13 | | | 11 | | | 9.1 | | | 9.1 | | | |
| D | " | | | 11 | | | 7.8 | | | 7.2 | | | 7.2 | | | |
| H | " | | | 20 | | | 10 | | | 8.5 | | | 5.0 | | | |
| X | " | | | 17 | | | 10 | | | 7.0 | | | 5.9 | | | |
| (average) | | | | (17.3) | | | (10.2) | | | (8.8) | | | (7.1) | | | (5.6) |
| A | 1589 | | | | | | | 39 | 6144 | 13 | | | | | | |
| B | " | | | | | | | | | 7.2 | | | | | | |
| C | " | | | | | | | | | 10 | | | | | | |
| D | " | | | | | | | | | 7.2 | | | | | | |
| H | " | | | | | | | | | 8.5 | | | | | | |
| X | " | | | | | | | | | 9.5 | | | | | | |
| (average) | | | | | | | | | | (9.2) | | | | | | |
| Code | | | | | | | | | | | | | | | | |
| A | 1644 | 11 | 4073 | 30 | 26 | 5420 | 20 | 34 | 5876 | 14 | 42 | 6262 | 10 | 860 | 7448 | 5.5, 6.5 |
| B | " | | | 20 | | | 14 | | | 10 | | | 8.0 | | | 5.5, 6.5 |
| C | | | | | | | | | | | | | | | | |
| D | | | | | | | | | | | | | | | | |
| H | | | | | | | | | | | | | | | | |
| X | | | | | | | | | | | | | | | | |
| (average) | | | | (25) | | | (17) | | | (12) | | | (9.0) | | | (6.0) |

TABLE III

Slab grain size ($d_{REX}$) after reheating to 1563° K. (1290° C.)
(grain sizes calculated based on equivalent circular diameter model - in mm)

| Material | Preroll Temp. °K. | % Reduction in Prerolling (Single Pass) | | | | | | | | |
|---|---|---|---|---|---|---|---|---|---|---|
| | | 10% Reduction | | | 25% Reduction | | | 30% Reduction | | |
| | | E | $(K.^*)^{-1}$ | $d_{REX}$ | E | $(K.^*)^{-1}$ | $d_{REX}$ | E | $(K.^*)^{-1}$ | $d_{REX}$ |
| I | 1255 | | | | 141 | 7727 | 3.0 | | | |
| M | " | | | | | | 3.0 | | | |
| I | 1422 | | | | 69 | 6615 | 3.0 | | | |
| M | " | | | | | | 9.0 | | | |
| I | 1477 | | | | 57 | 6303 | 4.0 | | | |
| M | " | | | | | | 6.0 | | | |
| I | 1561 | 15 | 4187 | 44 | 43 | 5870 | 19 | 54 | 6230 | 50 |
| M | " | | | 35 | | | 17 | | | 14 |
| I | 1589 | 13 | 4053 | 38 | 39 | 5736 | 35 | 50 | 6096 | 24 |
| M | " | | | 25 | | | 15 | | | 19 |
| I | 1644 | | | | 34 | 5486 | 25 | | | |
| M | " | | | | | | 22 | | | |

TABLE IV

Slab grain size ($d_{REX}$) after reheating to 1533°-1673° K. (1260°-1400° C.)
(grain sizes calculated based on equivalent circular diameter model - in mm)

| Material | Preroll Temp. °K. | Preroll % Redn. | E | Slab Reheat Temperature °K. | | | | | | | | | |
|---|---|---|---|---|---|---|---|---|---|---|---|---|---|
| | | | | 1533° | | 1561° | | 1577° | | 1589° | | 1672° | |
| | | | | $(K.^*)^{-1}$ | $d_{REX}$ | $(K.^*)^{-1}$ | $d_{REX}$ | $(K.^*)^{-1}$ | $d_{REX}$ | $(K.^*)^{-1}$ | $d_{REX}$ | $(K.^*)^{-1}$ | $d_{REX}$ |
| I | 1255 | 30 | 177 | | | 8687 | 2.4 | | | | | | |
| M | " | " | | | | | 2.2 | | | | | | |
| I | 1422 | " | 87 | | | 6975 | 2.5 | | | | | 7471 | 3.8 |
| M | " | " | | | | | 3.0 | | | | | | 4.6 |
| I | 1477 | " | 71 | | | 6664 | 3.5 | | | | | | |
| M | " | " | | | | | 3.8 | | | | | | |
| I | 1485 | " | 69 | | | | | | | | | 7091 | 6.8 |
| M | " | " | | | | | | | | | | | 5.3 |
| I | 1561 | " | 54 | 5119 | 30, 28 | 6230 | 50, 28, 16 | 6294 | 20, 19 | 6342 | 6.5 | 6673 | 5.6, 6.8 |
| M | " | " | | | 15, 7.2 | | 14, 12, 6.5 | | 14, 5.2 | | 5.0, 17 | | 6.8, 8.5 |
| I | 1589 | | 50 | | | 6096 | 44, 18, 21 | 6159 | 19, 10 | 6206 | 9.0 | 6530 | 5.6, 8.8 |
| M | " | " | | | | | 19, 25, 21 | | 25, 4.0 | | 4.6 | | 6.8 |
| I | 1617 | " | 46 | | | 5967 | 24 | 6028 | 14 | 6074 | 6.8 | 6391 | 7.1 |
| M | " | " | | | | | — | | 21 | — | | — | |
| I | 1644 | " | 42 | | | 5846 | 21 | | | | | 6262 | 12 |
| M | " | " | | | | | 25 | | | | | | 9 |
| I | 1255 | " | 362 | | | 9195 | 6.0 | | | | | | |
| M | " | " | | | | | — | | | | | | |
| I | 1422 | " | 177 | | | 8082 | 6.8 | | | | | 8657 | — |

TABLE IV-continued

| Material | Preroll Temp. °K. | Preroll % Redn. | E | Slab grain size ($d_{REX}$) after reheating to 1533°–1673° K. (1260°–1400° C.) (grain sizes calculated based on equivalent circular diameter model - in mm) Slab Reheat Temperature °K. 1533° $(K.^*)^{-1}$ | 1533° $d_{REX}$ | 1561° $(K.^*)^{-1}$ | 1561° $d_{REX}$ | 1577° $(K.^*)^{-1}$ | 1577° $d_{REX}$ | 1589° $(K.^*)^{-1}$ | 1589° $d_{REX}$ | 1672° $(K.^*)^{-1}$ | 1672° $d_{REX}$ |
|---|---|---|---|---|---|---|---|---|---|---|---|---|---|
| M | " | " | | | | | 5.3 | | | | | | 5.2 |
| I | 1561 | " | 110 | 7206 | 2.5 | 7338 | 3.0 | 7413 | 3.9 | 7469 | 4.5 | 7860 | 5.6, 5.8 |
| M | " | " | | | 4.0, 5.2 | | 6.2 | | 6.5 | | 6.6 | | 6.7 |
| I | 1589 | " | 101 | | | 7204 | 7.1 | 7278 | 7.8 | 7333 | 4.3 | 7716 | 5.4 |
| M | " | " | | | | | 7.0 | | 4.6 | | 5.6 | | 5.7 |
| I | 1644 | " | 86 | | | | | | | | | 7448 | 6.0 |
| M | " | " | | | | | | | | | | | |

TABLE V

Calculated Maximum Prerolling Temperature vs. Slab Reheating Temperature and % Reduction in Prerolling - Single Pass Reduction

| Slab Reheat Temp. °K. | % Reduction in Prerolling 25% Maximum Prerolling Temp. °K. | 30% |
|---|---|---|
| 1561 | 1425 | 1527 |
| 1589 | 1480 | 1549 |
| 1616 | 1500 | 1571 |
| 1673 | 1540 | 1615 |

What is claimed is:

1. A method of controlling strain rate during prerolling of silicon steel strand cast slabs, comprising the steps of providing a strand cast slab containing from 2% to 4% silicon and having a thickness of about 10 to about 30 centimeters, prerolling the slab while at a temperature not exceeding 1673° K. (1400° C.) with a reduction in thickness up to 50%, reheating said prerolled slab to a temperature between about 1533° and 1673° K. (1260° and 1400° C.), and correlating the slab prerolling temperature, percentage of reduction in prerolling, and the reheat temperature, whereby to control the strain rate during prerolling and to obtain an average grain diameter not exceeding about 9 mm after said reheating, in accordance with the equation:

$$(K^*)^{-1} = (T_{SR}) \times \ln\left[\dot{\epsilon}^{0.15} \exp\left(\frac{7616}{T_{PR}}\right) \ln\left(\frac{t_i}{t_f}\right)\right] \geqq 6400$$

where $(K^*)^{-1}$=strain/recrystallization parameter

Tsr=slab reheating temperature °K.

$\epsilon$=strain rate in prerolling $T_{PR}$=slab prerolling temperature °K.

$t_i$=as-cast slab thickness $t_f$=prerolled slab thickness.

2. The method claimed in claim 1, wherein said slab is prerolled at a temperature of about 1088° to about 1643° K.

3. The method claimed in claim 1, wherein said prerolling comprises a reduction in thickness of 20% to 50%.

4. The method claimed in claim 1, wherein said prerolled slab is reheated to a temperature of about 1563° to 1673° K.

5. The method claimed in claim 1, wherein said slab is prerolled at a temperature of about 1223° to 1673° K., wherein said prerolling comprises a reduction in thickness of 25% to 40%, and wherein said prerolled slab is reheated to a temperature of about 1623° to 1673° K., whereby to obtain an average grain diameter not exceeding about 7 mm after said reheating.

6. The method claimed in claim 1, wherein, for single-pass prerolling, the percentage of reduction in prerolling is from 25% to 30%, the maximum prerolling temperature ranges from 1425° to 1615° K., and the slab reheat temperature ranges from about 1560° to about 1673° K.

7. The method claimed in claim 1, wherein, for single-pass prerolling, the maximum slab prerolling temperature, percentage of reduction in prerolling, and reheat temperature are correlated as follows:

| slab reheat temp. °K. | 25% reduction maximum prerolling temperature °K. | 30% reduction |
|---|---|---|
| 1561° | 1425° | 1527° |
| 1589° | 1480° | 1549° |
| 1616° | 1500° | 1571° |
| 1673° | 1540° | 1615° |

8. The method claimed in claim 1, wherein the percentage of reduction in prerolling is from 30% to 50%, the prerolling temperature ranges from greater than 1523° to about 1643° K., and the slab reheat temperature is from about 1561° to about 1673° K.

9. The method claimed in claim 1, wherein said slab contains, in weight percent, from about 0.001% to 0.085% carbon, about 0.04% to 0.15% manganese, about 0.01% to 0.03% sulfur and/or selenium, about 2.95% to 3.35% silicon, about 0.001% to 0.065% aluminum, about 0.001% to 0.010% nitrogen, and balance essentially iron.

10. The method claimed in claim 1, wherein said slab contains, in weight percent, up to about 0.07% carbon, about 2.7% to 3.3% silicon, about 0.05% to about 0.15% manganese, about 0.02% to about 0.035% sulfur and/or selenium, about 0.001% to about 0.065% total aluminum, about 0.0005% to about 0.009% nitrogen, and balance essentially iron.

11. A method for control of grain size in a silicon steel strand cast slab prior to hot rolling thereof, said strand cast slab containing from 2% to 4% silicon and having a thickness of about 10 to about 30 centimeters, which comprises prerolling the slab while at a temperature not exceeding 1673° K. (1400° C.) with a reduction in thickness up to 50%, reheating said prerolled slab to a temperature between 1533° and 1673° K. (1260° and 1400° C.), and adjusting the temperature to which said prerolled slab is reheated, whereby to obtain an average grain diameter not exceeding about 9 mm after said reheating, in accordance with the equation:

$$(K^*)^{-1} = (T_{SR}) \times \ln\left[\dot{\epsilon}^{0.15} \exp\left(\frac{7616}{T_{PR}}\right) \ln\left(\frac{t_i}{t_f}\right)\right] \geqq 6400$$

where $(K^*)^{-1}$=strain/recrystallization parameter

Tsr=slab reheating temperature °K.

$\epsilon$=strain rate in prerolling $T_{PR}$=slab prerolling temperature °K.

$t_i$=as-cast slab thickness $t_f$=prerolled slab thickness.

12. A method for controlling prerolling temperature and percent of reduction in prerolling of silicon steel strand cast slabs containing from 2% to 4% silicon and having a thickness of about 10 to about 30 centimeters, wherein said slab is prerolled at a temperature not exceeding 1673° K. (1400° C.) with a reduction in thickness up to 50%, reheated to a temperature between about 1533° and 1673° K. (1260° and 1400° C.) and wherein the slab prerolling temperature and percent reduction in thickness in prerolling is correlated with the reheat temperature, whereby to control the strain rate during prerolling, in accordance with the equation:

$$(K^*)^{-1} = (T_{SR}) \times \ln\left[\dot{\epsilon}^{0.15} \exp\left(\frac{7616}{T_{PR}}\right) \ln\left(\frac{t_i}{t_f}\right)\right] \geqq 6400$$

where $(K^*)^{-1}$=strain/recrystallization parameter

Tsr=slab reheating temperature °K.

$\epsilon$=strain rate in prerolling $T_{PR}$=slab prerolling temperature °K.

$t_i$=as-cast slab thickness $t_f$=prerolled slab thickness.

* * * * *